US005462197A

United States Patent [19]

Pound

[11] Patent Number: 5,462,197

[45] Date of Patent: Oct. 31, 1995

[54] TOWELETTE DISPENSING DEVICE FOR CLEANING A TOILET SEAT

[76] Inventor: John D. Pound, 272 Alma Road, North Caulfield 3161, Victoria, Australia

[21] Appl. No.: 241,187

[22] Filed: May 11, 1994

[51] Int. Cl.[6] ..... A47K 10/32

[52] U.S. Cl. ..... 221/46; 221/49; 221/62; 221/287

[58] Field of Search ..... 221/287, 33, 45, 221/46, 49, 50, 62

[56] References Cited

U.S. PATENT DOCUMENTS

| | | | |
|---|---|---|---|
| 2,738,898 | 3/1956 | Lee | 221/62 X |
| 3,967,756 | 7/1976 | Barish | 221/45 |
| 4,264,992 | 5/1981 | Tromp | 221/46 X |
| 4,411,374 | 10/1983 | Hotchkiss . | |
| 4,535,912 | 8/1985 | Bonk | 221/46 |
| 4,735,317 | 4/1988 | Sussman et al. | 221/46 X |
| 4,997,105 | 3/1991 | Fischer | 221/45 |

FOREIGN PATENT DOCUMENTS

| | | | |
|---|---|---|---|
| 1182280 | 7/1989 | Japan | 221/46 X |
| WO9221274 | 12/1992 | WIPO | 221/45 X |

*Primary Examiner*—William E. Terrell
*Assistant Examiner*—Dean A. Reichard
*Attorney, Agent, or Firm*—Michael I. Kroll

[57] ABSTRACT

A towelette dispensing device is provided, for cleaning a toilet seat on a toilet bowl, which consists of a receptacle mountable onto a vertical flat surface adjacent the toilet seat. A package of towelettes can be inserted into the receptacle. A towelette can be extracted, one at a time, from the receptacle by a person, to wipe clean the toilet seat used by another person previously. This will satisfy a concern and need for individual personal hygiene by lessening the danger of germs being transmitted from the toilet seat.

7 Claims, 2 Drawing Sheets

TOWELETTE DISPENSING DEVICE FOR CLEANING A TOILET SEAT

DESCRIPTION OF THE PRIOR ART

Numerous cleansing tissues have been provided in prior art that are adapted to be utilized in cleaning and disinfecting various articles, such as in a home or at a business. While these units may be suitable for the particular purpose to which they address, they would not be as suitable for the purposes of the present invention as heretofore described.

SUMMARY OF THE INVENTION

A primary object of the present invention is to provide a towelette dispensing device for cleaning a toilet seat that will overcome the shortcomings of the prior art devices.

Another object is to provide a towelette dispensing device for cleaning a toilet seat that will satisfy a concern and need for individual personal hygiene, by lessening the danger of germs being transmitted from the toilet seat.

An additional object is to provide a towelette dispensing device for cleaning a toilet seat that will maintain a package of towelettes moistened with disinfectant solution mounted near a toilet tissue dispenser adjacent a toilet, so that a towelette can be extracted, one at a time, therefrom to wipe clean the toilet seat used by another person previously.

A further object is to provide a towelette dispensing device for cleaning a toilet seat that is simple and easy to use.

A still further object is to provide a towelette dispensing device for cleaning a toilet seat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
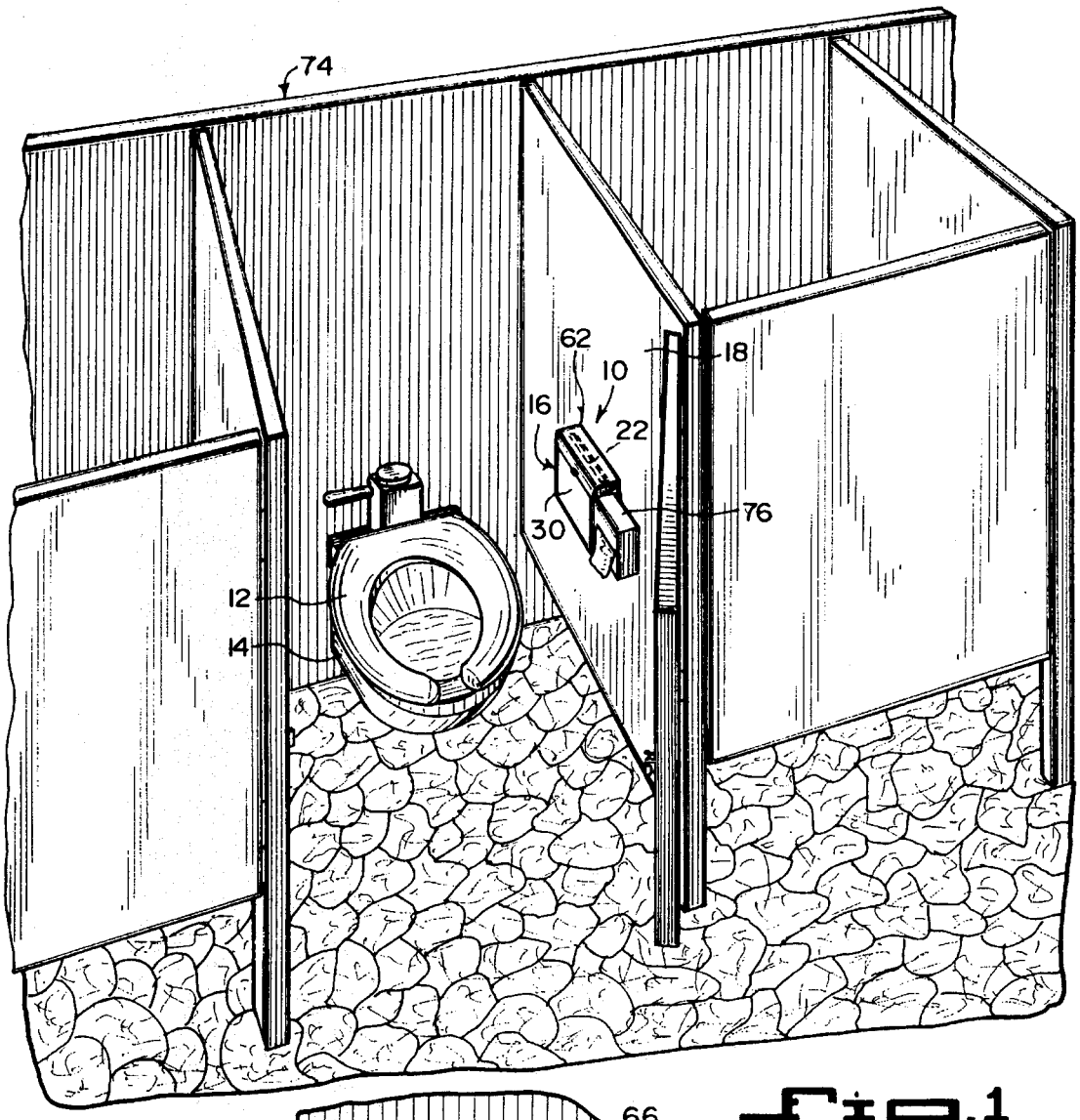
FIG. 1 is a perspective view of a toilet stall with the instant invention mounted in a closed position next to a toilet tissue dispenser at one side thereof.

Turning now descriptively to the drawings, in which similar reference characters denote similar elements throughout the several views, FIGS. 1 through 4 illustrate a towelette dispensing device 10, for cleaning a toilet seat 12 on a toilet bowl 14, which consists of a receptacle 16 mountable onto a vertical flat surface 18 adjacent the toilet seat 12. A package of towelettes 20 can be inserted into the receptacle 16. A towelette 22 can be extracted one at a time from the receptacle 16 by a person, to wipe clean the toilet seat 12 used by another person previously. This will satisfy a concern and need for individual personal hygiene by lessening the danger of germs being transmitted from the toilet seat 12.

The receptacle 16 includes a bottom wall 24, with a pair of side walls 26, 28, each extending upwardly from the bottom wall 24. A front wall 30 also extends upwardly from the bottom wall 24, while a rear wall 32 extends upwardly from the bottom wall 24, so as to form a compartment 34 with an open top 36, for the insertion of the package of towelettes 20 therein.

The package of towelettes comprises a soft container 38, having a perforated top 40, to allow a plurality of the towelettes 22 to be stacked within the soft container 38. Once the perforated top 40 is split open, each towelette 22 can be pulled out, one at a time, for use. The towelettes 22 are fabricated out of a paper material 42, moistened with a disinfectant solution 44, so that each towelette 22 can clean and disinfect the toilet seat 12.

Figure 4:
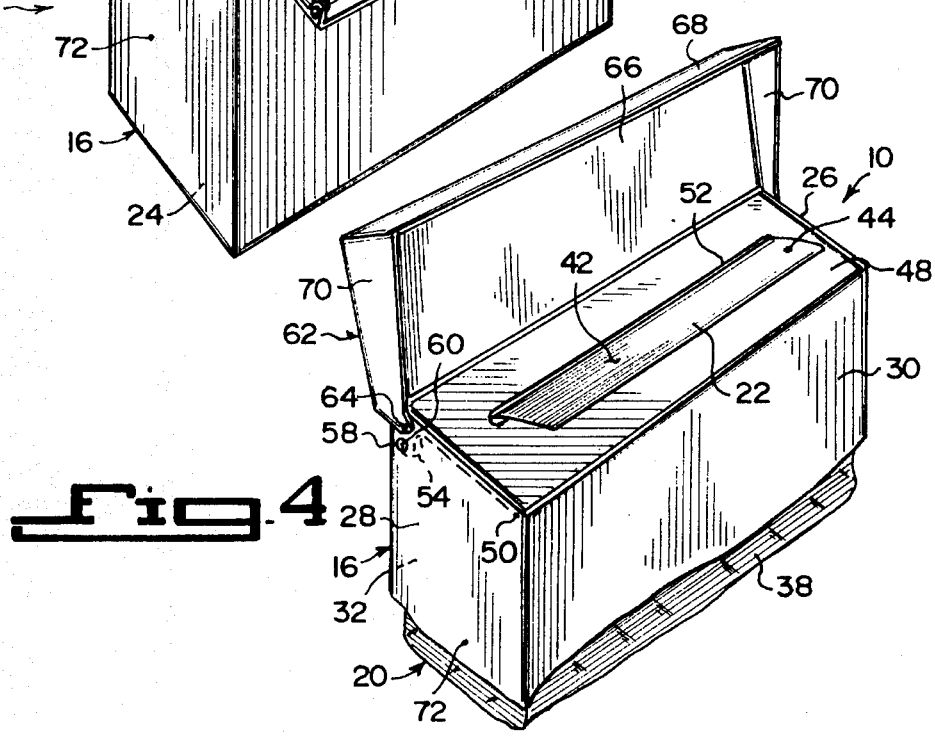
FIG. 4 is an enlarged front perspective view similar to FIG. 3 with parts broken away, showing the package of towelettes inserted and ready to be used.

The receptacle 16 further contains a lip 46, formed on a top edge of the first side wall 26 and the rear wall 32. A flap 48 is hinged at 50 to a top edge of the first and second side walls 26, 28 adjacent the front wall 30. The flap 48 has a longitudinal slot 52. When the flap 48 is in a closed position over and onto the lip 46, as shown in FIG. 4, the longitudinal slot 52 will align up with the split open perforated top 40 of the soft container 38 within the compartment 34 of the receptacle 16, to allow each towelette 22 to be pulled out through the longitudinal slot 52.

A projection 54 is formed on a free corner of the flap 48. When the flap 48 is in the closed position, the projection 54 will extend into the compartment 34 at the top edge of the second side wall 28 adjacent the rear wall 32. A lock cylinder 56 is carried within the projection 54. A lock core 58 having a keyway 60, is carried within the second side wall 28 at the top edge adjacent the rear wall 32. When the flap 48 is in the closed position, the lock cylinder 56 will align up with the lock core 58, allowing a key inserted into the keyway 60 to retain the lock core 58 to the lock cylinder 56. This prevents the flap 48 from going into an open position and eliminates an unauthorized removal of the package of towelettes 20 from the receptacle 16.

A flip top lid 62 is hinged at 64 to the top edge of the first and second side walls 26, 28 adjacent the rear wall 32. When the flap 48 is in the closed position, the flip top lid 62 in a raised position, as shown in FIG. 4, will allow each towelette 22 to be pulled out through the longitudinal slot 52. When the flap 48 is in the closed position and the flip to lid 62 is in a lowered position over the flap 48, as shown in FIGS. 1 and 2, it will prevent the upper towelette 22 from drying out.

The flip top lid 62 contains a plate 66, a front partition 68 extending from the plate and a pair of side partitions 70 extending from the plate 66. When the flip top lid 62 is in the lowered position, the plate 66 will cover the flap 48. The front partition 68 and the side partitions 70 will cover over the top edges of the front wall 30 and the side walls 26, 28 of the receptacle 16.

The receptacle is fabricated out of a durable non-corrosive material 72, such as plastic and metal.

Figure 2:
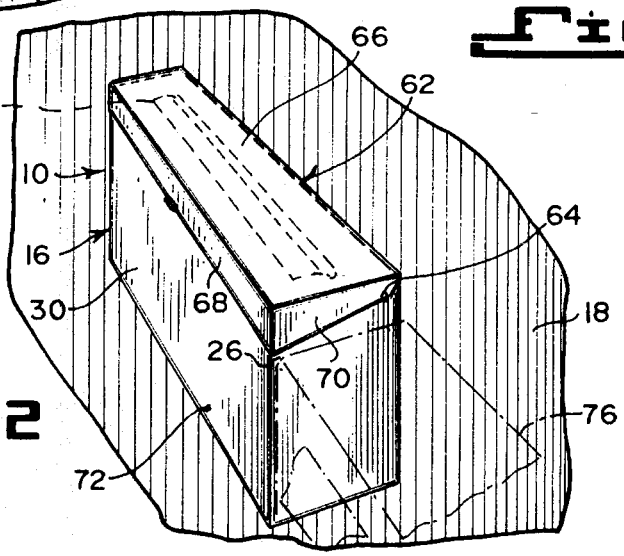
FIG. 2 is an enlarged side perspective view of the instant invention.
Figure 3:
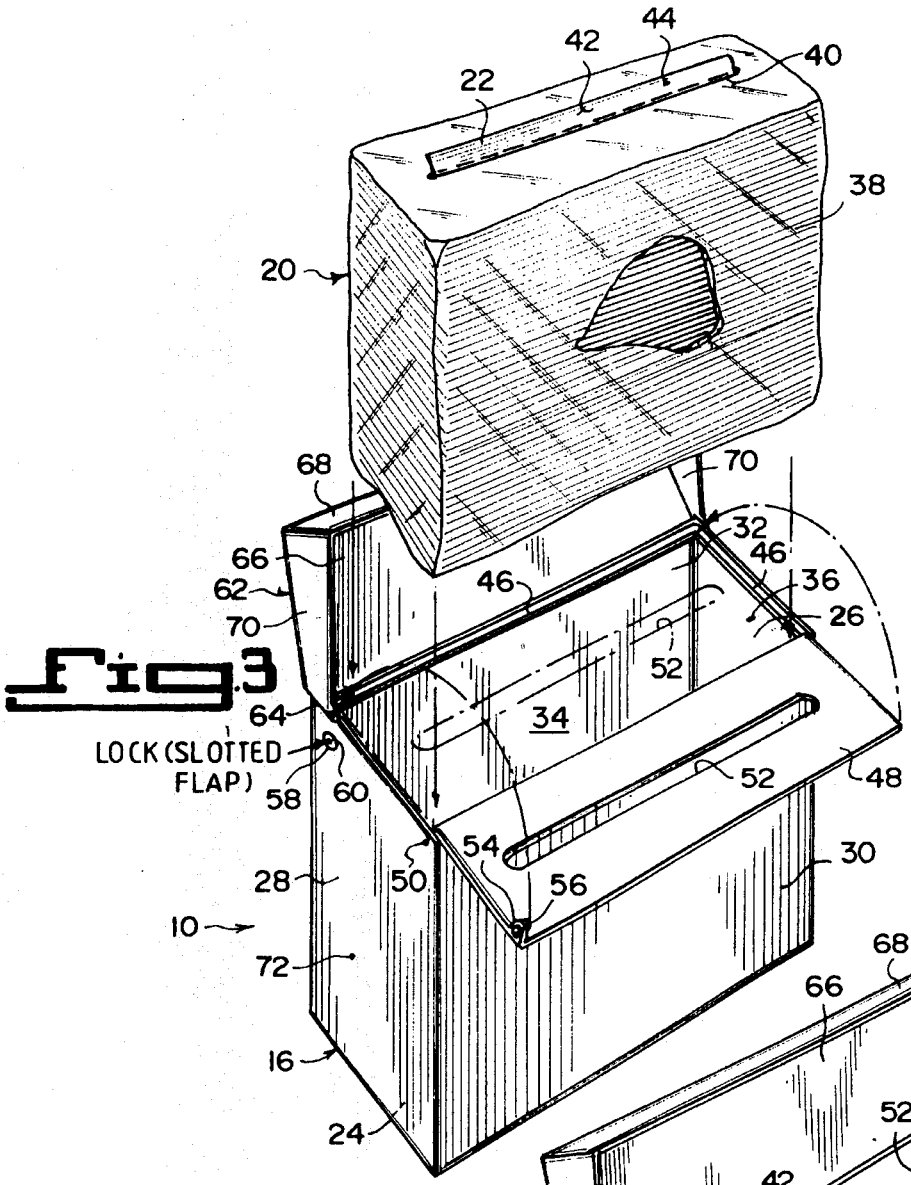
FIG. 3 is an enlarged front perspective view of the instant invention in an opened position, showing a package of towelettes being inserted therein.

As shown in FIGS. 1 and 2, the towelette dispensing device 10 is mounted to a vertical flat surface 18, which is a partition wall in a toilet stall 74. A toilet tissue dispenser 76 is positioned next to the towelette dispensing device 10, so that a person entering the toilet stall 74 will have easy access to the towelettes 22, to clean and disinfect the toilet seat 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A towelette dispensing device for cleaning a toilet seat on a toilet bowl, which comprises:

a) a receptacle mountable onto a vertical flat surface adjacent the toilet seat, said receptacle including a bottom wall, first and second side walls, each extending upwardly from said bottom wall, a front wall extending upwardly from said bottom wall, and a rear wall extending upwardly from said bottom wall, so as to form a compartment with an open top for the insertion of a package of towelettes therein, said receptacle further including a lip formed on a top edge of said first side wall and said rear wall, and a flap hinged to a top edge of said first and second side walls adjacent said front wall, said flap having a longitudinal slot, so that when said flap is in a closed position over and onto said lip, said longitudinal slot will align with a perforated top of a soft container within said compartment of said receptacle, to allow each said towelette to be pulled out through said longitudinal slot; and b) a package of towelettes which can be inserted into said receptacle, so that a towelette can be extracted, one at a time, from said receptacle by a person to wipe clean the toilet seat used by another person previously, which will satisfy a concern and need for individual personal hygiene by lessening the danger of germs being transmitted from the toilet seat, said package of towelettes including said soft container having said perforated top, to allow a plurality of said towelettes to be stacked within said soft container, so that once said perforated top is split open, each said towelette can be pulled out, one at a time, for use, said towelettes being fabricated out of a paper material and moistened with a disinfectant solution, so that each said towelette can clean and disinfect the toilet seat.

2. A towelette dispensing device as recited in claim 1, wherein said receptacle further includes:

a) a projection formed on a free corner of said flap, so that when said flap is in the closed position, said projection will extend into said compartment at the top edge of said second side wall adjacent said rear wall;

b) a lock cylinder carried within said projection; and c) a lock core having a keyway carried within said second side wall at the top edge adjacent said rear wall, so that when said flap is in the closed position said lock cylinder will align with said lock core, allowing a key inserted into said keyway to retain said lock core to said lock cylinder, to prevent said flap from going into an open position and eliminate an unauthorized removal of said package of towelettes from said receptacle.

3. A towelette dispensing device as recited in claim 2, wherein said receptacle further includes a flip top lid hinged to the top edge of said first and second side walls adjacent said rear wall, so that when said flap is in the closed position, said flip top lid in a raised position will allow each said towelette to be pulled out through said longitudinal slot, when said flap is in the closed position and said flip top lid is in a lowered position over said flap it will prevent an upper towelette from drying out.

4. A towelette dispensing device as recited in claim 3, wherein said flip top lid includes:

a) a plate;

b) a front partition extending from said plate; and c) a pair of side partitions extending from said plate, so that when said flip top lid is in the lowered position said plate will cover said flap, while said front partition and said side partitions will cover over the top edges of said front wall and said side walls of said receptacle.

5. A towelette dispensing device as recited in claim 4, wherein said receptacle is fabricated out of a durable non-corrosive material.

6. A towelette dispensing device as recited in claim 5, wherein said durable non-corrosive material is plastic.

7. A towelette dispensing device as recited in claim 5, wherein said durable non-corrosive material is metal.

* * * * *